US007464454B2

(12) United States Patent
Aasgaard

(10) Patent No.: US 7,464,454 B2
(45) **Date of Patent: *Dec. 16, 2008**

(54) METHOD FOR SETTING SELF-TAPPING RIVETS

(75) Inventor: A. L. Pepper Aasgaard, Omaha, NE (US)

(73) Assignee: Abeo, LLC, Omaha, NE (US)

( * ) Notice: Subject to any disclaimer, the term of this patent is extended or adjusted under 35 U.S.C. 154(b) by 289 days.

This patent is subject to a terminal disclaimer.

(21) Appl. No.: 11/151,684

(22) Filed: Jun. 13, 2005

(65) Prior Publication Data

US 2006/0112791 A1 Jun. 1, 2006

Related U.S. Application Data

(63) Continuation of application No. 10/719,748, filed on Nov. 21, 2003, now Pat. No. 6,904,831.

(60) Provisional application No. 60/428,103, filed on Nov. 21, 2002.

(51) Int. Cl.
*B21D 39/00* (2006.01)
*B23Q 11/00* (2006.01)

(52) U.S. Cl. ..... 29/524.1; 81/57.3

(58) Field of Classification Search ..... 29/524, 29/418, 432.1, 524.1, 243.5, 243.521, 243.526, 29/243.53; 81/57.3–57.32, 54–57
See application file for complete search history.

(56) References Cited

U.S. PATENT DOCUMENTS 3,403,593 A 10/1968 Moore
3,750,518 A 8/1973 Rayburn
3,772,957 A 11/1973 Newton
3,935,786 A 2/1976 Murray et al.
4,085,337 A 4/1978 Moeller ..... 307/115
4,293,258 A 10/1981 McKewan
4,559,806 A 12/1985 Schwab ..... 72/391
4,629,380 A 12/1986 Gunkel et al.
4,910,992 A 3/1990 Stenberg et al.
4,990,042 A 2/1991 Szayer et al.
5,183,357 A 2/1993 Palm
5,344,267 A 9/1994 Stenberg et al.
5,473,805 A 12/1995 Wille ..... 29/243.526
5,960,667 A 10/1999 Hylwa et al. ..... 72/391.4
6,684,470 B1 2/2004 Joux ..... 29/243.521
6,904,831 B2 * 6/2005 Aasgaard ..... 81/57.3

* cited by examiner

*Primary Examiner*—John C Hong
(74) *Attorney, Agent, or Firm*—Barnes & Thornburg LLP

(57) ABSTRACT

A rivet setting device for setting a self-tapping rivet in a work piece includes a rotatable head for rotating a self-tapping rivet to form a hole in the work piece and a shank retracting assembly for compressing and spreading the hollow body of the self-tapping rivet, allowing the head of the self-tapping rivet to detach from the shank upon application of a predetermined tensile force. The rotatable head comprises a clutch having a body enclosing a plurality of bearings circumferentially located around the shank, for gripping the shank. The clutch is formed with a plurality of tapered channels for urging the bearings into engagement with the shank upon rotation of the clutch.

3 Claims, 5 Drawing Sheets

METHOD FOR SETTING SELF-TAPPING RIVETS

CROSS-REFERENCE TO RELATED APPLICATIONS

The present application is a continuation of U.S. application Ser. No. 10/719,748, filed Nov. 21, 2003, now U.S. Pat. No. 6,904,831 to be issued on Jun. 13, 2005, which claims the benefit under 35 U.S.C. § 119(e) of U.S. Provisional Application Ser. No. 60/428,103, filed Nov. 21, 2002. Said U.S. patent application Ser. No. 10/719,748 and U.S. Provisional Patent Application 60/428,103 are herein incorporated by reference in its entirety.

The present application also incorporates the following patents and patent applications by reference in their entirety:

| Pat/App No. | Title | Issued/Filed |
|---|---|---|
| 5,741,099 | Self-tapping Blind Setting Rivet Assembly | Apr. 21, 1998 |
| 5,762,456 | Self-tapping Blind Setting Bolt Rivet Assembly | Jun. 9, 1998 |
| 5,915,901 | Blind Setting Rivet Assembly | Jun. 29, 1999 |
| 10/050,084 | Self-Polishing and Tapping Rivet Assembly | Jan. 14, 2002 |

FIELD OF THE INVENTION

The present invention generally relates to the field of tools and devices for setting rivets, and more particularly to a rivet setting device suitable for setting self-tapping rivets.

BACKGROUND OF THE INVENTION

Blind setting rivets are usually set in a work piece using a rivet setting tool or device which may be pneumatically, electrically, or hydraulically powered. Blind setting rivets typically include a hollow rivet body and a mandrel disposed longitudinally within the hollow rivet body. The mandrel includes a shank terminating in a head for radially compressing and spreading the rivet body as the mandrel is retracted rearward relative to the rivet body. The shank includes an area of reduced diameter for allowing the head to detach from the shank upon application of predetermined tensile force applied to the shank. To set a blind setting rivet, the shank of the rivet mandrel is inserted into the rivet setting tool. The tubular portion of the hollow rivet body is inserted though a hole formed in the workpiece and the rivet setting device is activated, retracting the shank rearward relative to the rivet body causing the head to compress and spread the rivet body to set the rivet. The shank then separates from the head at the area of reduced diameter and is discarded.

Self-tapping, blind setting rivets, as described in U.S. Pat. Nos. 5,741,099, 5,762,456, 5,915,901 and in U.S. patent application Ser. No. 10/050,084, include a self-tapping head that taps a hole in the work piece. In this manner, a separate hole-drilling step may be eliminated when applying the rivet. However, because conventional rivet setting tools do not rotate the mandrel of the rivet, application of such self-tapping rivets currently requires the use of a drill for rotating the rivet mandrel to tap a hole in the workpiece. The rivet setting device may then be used setting the rivet in the work piece and detaching the shank from the rivet. This use of two separate tools slows application of the rivets, reducing their advantage over non-tapping varieties.

Consequently, it would be advantageous to provide a rivet setting device suitable for setting self-tapping rivets. The rivet setting device should be capable of gripping and turning the mandrel of the rivet in order to turn the self-tapping head of the rivet for tapping a hole in the workpiece

SUMMARY OF THE INVENTION

The present invention is directed to a rivet setting device for setting a self-tapping rivet in a work piece. The rivet setting device includes a rotatable head for rotating a self-tapping rivet to form a hole in the work piece, and a shank retracting assembly for compressing and spreading the hollow body of the self-tapping rivet, allowing the head of the self-tapping rivet to detach from the shank upon application of a predetermined tensile force.

In one specific embodiment, the rotatable head comprises a clutch including a clutch body enclosing a plurality of bearings circumferentially located around the shank, for gripping the shank. In this embodiment, the clutch body is formed with a plurality of tapered channels for urging or forcing the bearings into engagement with the shank upon rotation of the clutch.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
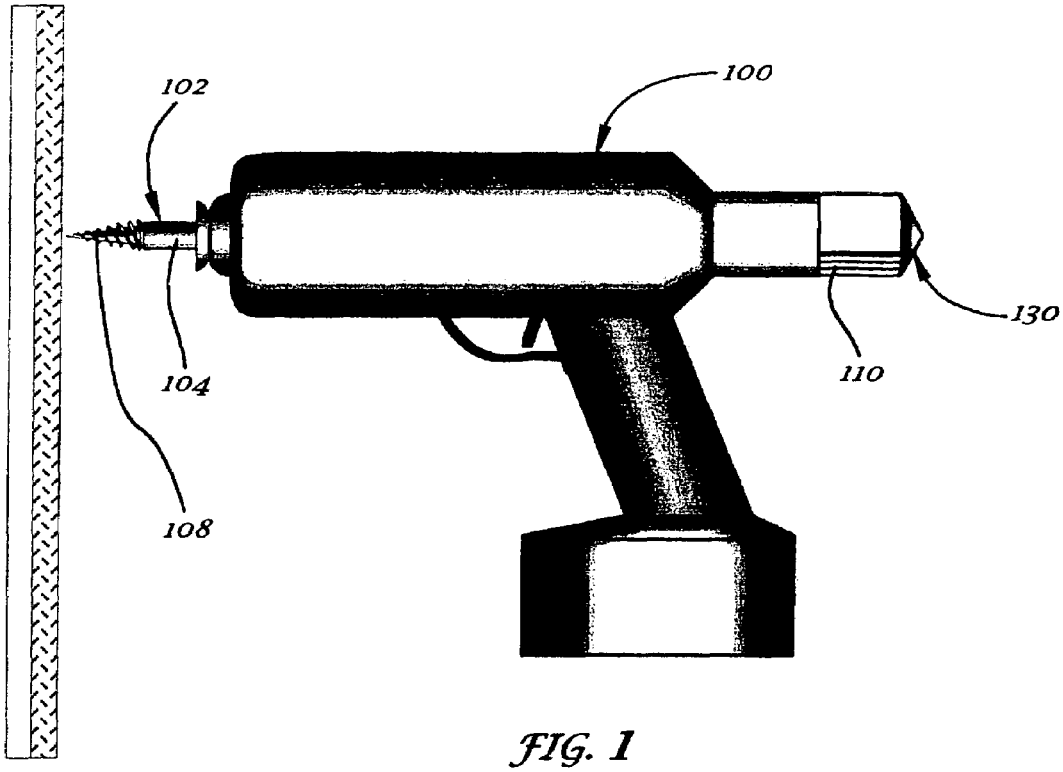
FIG. 1 is a partial cross-sectional side elevational view illustrating a rivet setting device in accordance with an exemplary embodiment of the present invention.
Figure 2:
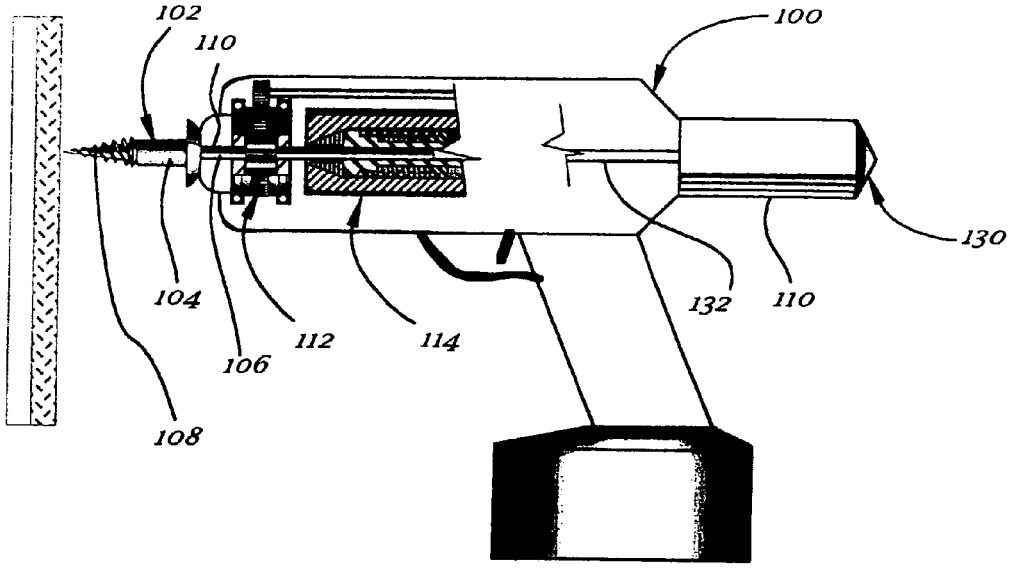
FIG. 2 is cross-sectional side elevational views illustrating the rivet setting device shown in FIG. 1, wherein a self-tapping rivet is loaded in the rivet setting device.
Figure 3:
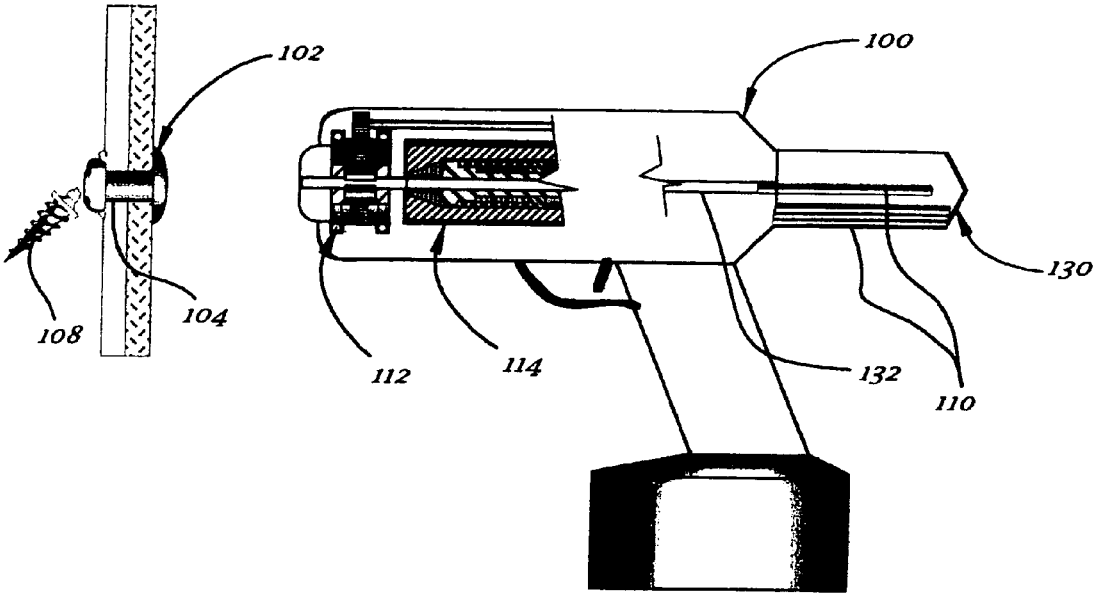
FIG. 3 is a cross-sectional side elevational views illustrating the rivet setting device shown in FIG. 1, wherein a shank of the self-tapping rivet has been separated from a head of the self-tapping rivet.

Reference will now be made in detail to the presently preferred embodiments of the invention, examples of which are illustrated in the accompanying drawings.

Referring generally to FIGS. 1 through 6, a rivet setting device 100 is described in accordance with an exemplary embodiment of the present invention. The rivet setting device 100 is for setting a self-tapping rivet 102 in a work piece. An exemplary self-tapping rivet 102 includes a hollow rivet body 104 and a mandrel 106 extending longitudinally through the hollow rivet body 104. The mandrel 106 includes a self-tapping head 108 for forming a hole in the work piece and a shank 110, fixedly connected to the self-tapping head 108 for rotating the self-tapping head 108 and cutting through the work piece. After the self-tapping head 108 has passed through the hole formed in the work piece, the hollow rivet body 104 is compressed and spread by the self-tapping head 108 as the mandrel 106 is retracted rearward relative to the hollow rivet body 104. The rearward tensile force is applied to the shank 110, which has an area of reduced diameter for allowing the self-tapping head 108 to detach from the shank 110 upon application of a predetermined tensile force. Preferably, the predetermined tensile force applied to the shank 110 causes separation of the self-tapping head 108 from the shank 110 upon sufficient compression and spreading of the hollow rivet body 104. Exemplary self tapping rivet assemblies suitable for use by the rivet setting device 100 of the present invention are described in U.S. Pat. No. 5,741,099, entitled Self-tapping Blind Setting Rivet Assembly, issued Apr. 21, 1998; U.S. Pat. No. 5,762,456, entitled Self-tapping Blind Setting Bolt Rivet Assembly, issued Jun. 9, 1998; and U.S. Pat. No. 5,915,901, entitled Blind Setting Rivet Assembly, issued Jun. 29, 1999; and in U.S. patent application Ser. No. 10/050,084, entitled Self-Polishing and Tapping Rivet Assembly, filed Jan. 14, 2002, which are herein incorporated by reference in their entirety. The rivet setting device 100 of the present invention may also be suitable for setting conventional non self-tapping blind setting rivet assemblies.

Figure 4A:
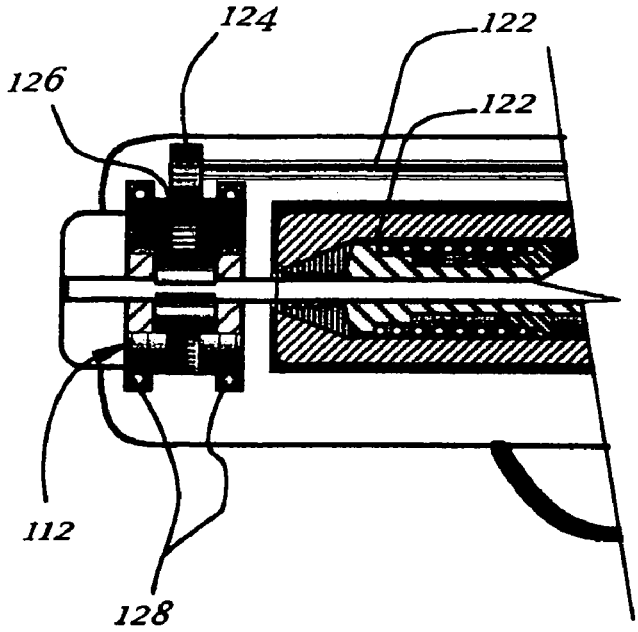
FIGS. 4A, 4B, 4C and 4D are cross-sectional side elevational views illustrating a rotatable head and shank retracting assembly of a rivet setting device in accordance with an exemplary embodiment of the present invention.
Figure 4B:
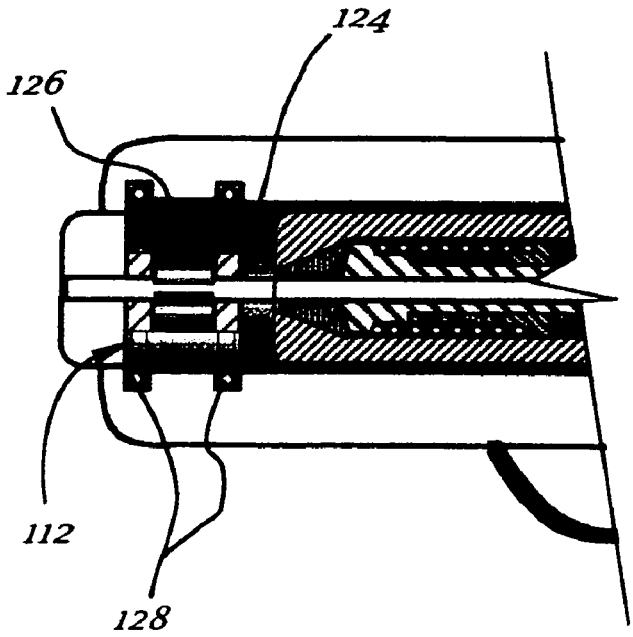
Figure 4C:
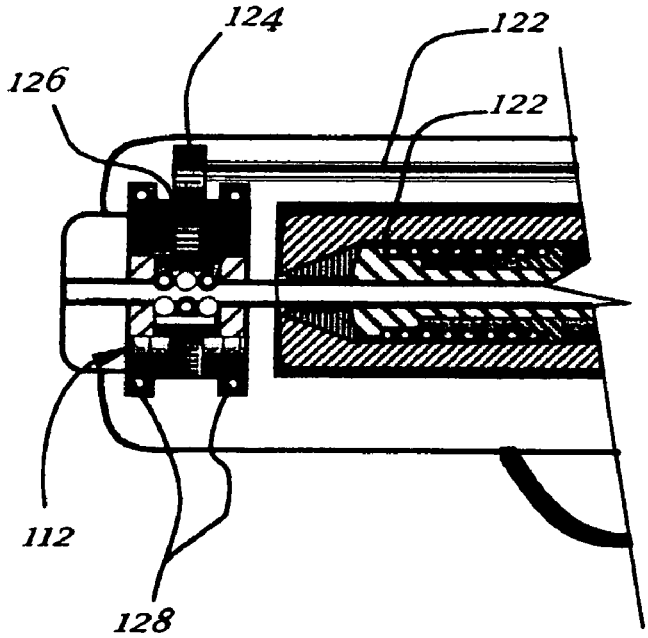
Figure 4D:
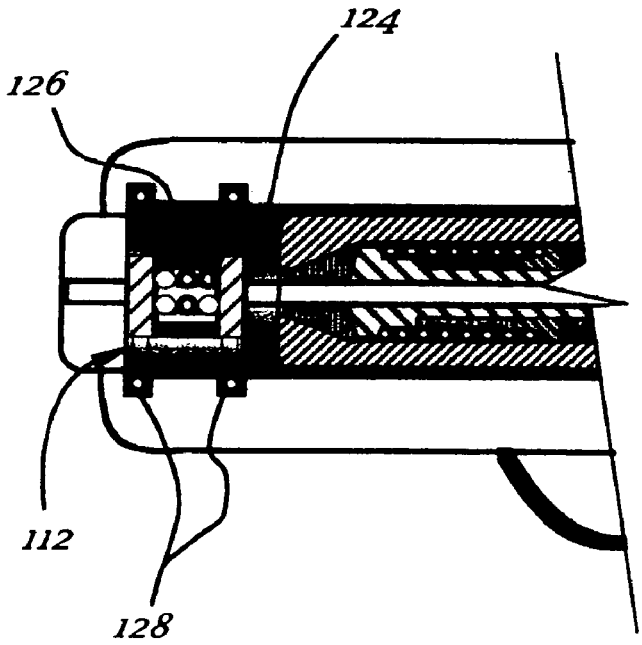
Figure 5:
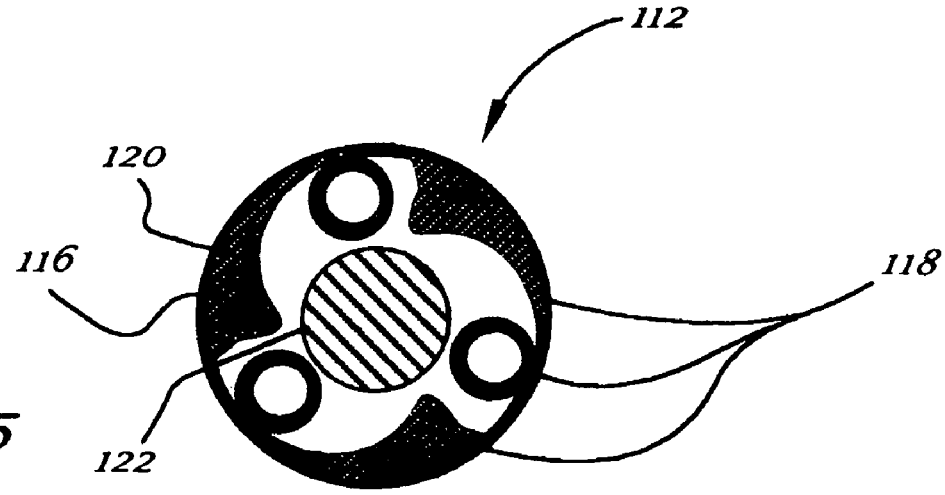
FIG. 5 is a front elevational view illustrating the clutch of the rotatable head shown in FIGS. 4A and 4B, wherein the clutch is in a rotational position for releasing a plurality of bearings from a shank.
Figure 6:
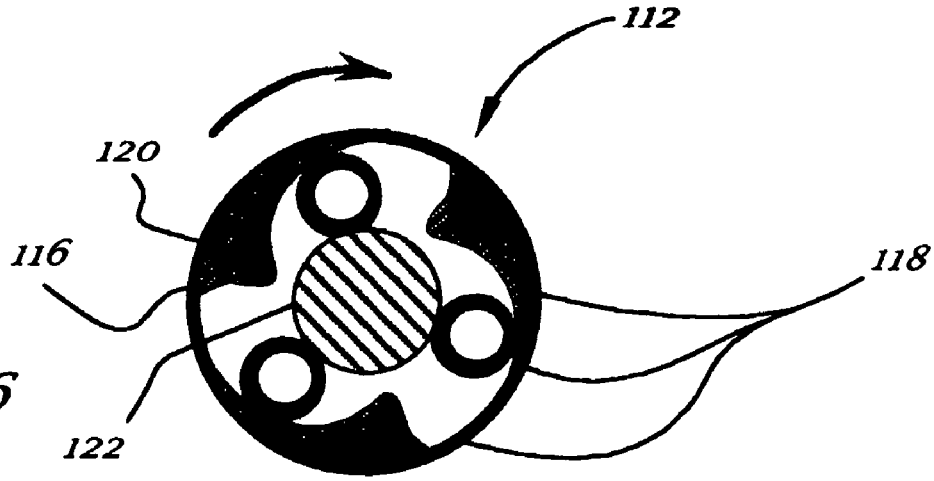
FIG. 6 is a front elevational view of the clutch illustrated in FIG. 5, wherein the clutch is in a rotational position for engaging a plurality of bearings with the shank, for rotating the shank.

The rivet setting device 100 includes a rotatable head 112 for rotating the shank 110 and the self-tapping head 108 of the mandrel 106 to form the hole in the work piece, and a shank retracting assembly 114 for retracting the mandrel 106 rearward relative to the hollow rivet body 104. In one embodiment of the rivet setting device 100, shown in FIGS. 2, 3 4A, and 4C, the rotatable head 112 and the shank retracting assembly 114 may be rotationally independent without departing from the scope and intent of the present invention. For instance, the shank retracting assembly 114 may remain stationary while the rotatable head 112 rotates, or the like. Alternatively, as shown in FIGS. 4B and 4D, the rotatable head 112 and the shank retracting assembly may be fixedly connected, rotating in concert. Additionally, it is contemplated that an auto feeder for supplying a plurality of self-tapping rivets 102 in succession may be added to the rivet setting device 100 without departing from the scope of the present invention.

Preferably, the rotatable head 112 stops rotating when the self-tapping head 108 of the mandrel 106 fully exits the work piece, in preparation for the action of the shank retracting assembly 114, which compresses and spreads the hollow rivet body 104 by retracting the shank 110 rearward relative to the hollow rivet body 104. For example, the rivet setting device 100 may sense a reduction in torque when the self-tapping head 108 fully exits the work piece, as the self-tapping head 108 will rotate with substantially less resistance when it is not cutting through the work piece. Alternately, a double indent trigger, a system of separate triggers, or the like may be used to control when the rotatable head 112 stops rotating and the shank retracting assembly 114 is activated. For instance, a trigger including a first indent position and a second indent position may be used; the first indent position causing rotation of the rotatable head 112 and the second trigger position causing the rotatable head 112 to stop rotating and activating the shank retracting assembly 114. Those of ordinary skill in the art will appreciate that many different trigger mechanisms and combinations may be used to control the rotation and timing of the rotatable head 112 and the shank retracting assembly 114 without departing from the scope and spirit of the present invention.

In exemplary embodiments of the present invention, the rotatable head 112 includes a clutch comprising a clutch body 116 enclosing a plurality of notched, tubular bearings 118 circumferentially located around the shank 110 of the mandrel 106, for gripping the shank 110. The clutch body 116 is formed with a plurality of tapered channels 120 for forcing the bearings 118 into engagement with the shank 110 upon rotation of the clutch 116. The tapered channels 120 narrow from a larger cross-sectional area to a smaller cross-sectional area counter to a direction of rotation of the rotatable head 112 for engaging the bearings 118 with the shank 110. Thus, the bearings 118 grip the shank 110 and rotate the self-tapping head 108 for cutting through the work piece when the rotatable head 112 is rotated in the direction for engaging the bearings 118 with the shank 110. While the shank 110 of the mandrel 106 is shown with a circular cross-sectional profile in the accompanying figures, it is contemplated that a shank having a multi-faceted cross-sectional profile, such as hexagonal, octagonal, or the like, may also be used with the rivet setting device 100 of the present invention. Those of ordinary skill in the art will further appreciate that the clutch body 116, the bearings 118, and the tapered channels 120 may be sized and configured for gripping shanks 110 having different sizes, cross-sectional profiles, or the like. For example, the clutch body 116, the bearings 118, and the tapered channels 120 may be sized and configured for gripping shanks 110 ranging from one-eighth inch to one-quarter inch in diameter.

Those of ordinary skill in the art will appreciate that many different types and varieties of clutches may be used without departing from the scope and spirit of the present invention. For instance, as shown in FIGS. 4C and 4D, the bearings 118 may be formed as ball bearings or the like, for allowing ease of insertion and loading of a self-tapping rivet 102 into the rivet setting device 100; however, in many applications, the notched, tubular bearings 118 shown in FIGS. 2, 3, 4A and 4B may be preferable for increased surface area contact and gripping force. For this reason, it is contemplated that the bearings 118 may be formed as ball bearings in combination with an annular taper formed in the shank 110 for engaging with the bearings 118, such as a Morse taper or the like. Such an annular taper may prevent rotation of the shank 110 relative to the bearings 118 when the rotatable head 112 is rotated in the direction for engaging the bearings 118 with the shank 110. It should be noted that the annular taper may correspond with the area of reduced diameter for allowing the self-tapping head 108 to detach from the shank 110 upon application of the predetermined tensile force, as previously mentioned. Those of ordinary skill in the art will further appreciate that the clutch 116 may be reversible, operating as a right-handed clutch or a left-handed clutch, depending on the orientation of the tapered channels 120.

In the exemplary embodiment of the rivet setting device 100 shown in the accompanying figures, the rotatable head 112 is rotated by an output drive shaft 122, driven by an electrical motor, a pneumatic drive system, a gas-powered engine, or the like. The output drive shaft 122 includes a gear 124 enmeshed with gear teeth 126 located circumferentially about the rotatable head 112. Preferably, the rotatable head 112 is seated in a plurality of bearings, such as ball bearings 128 or the like, for allowing smooth and efficient rotation of the rotatable head 112 as it is driven by the output drive shaft

122. Those of ordinary skill in the art will appreciate that the rotatable head 112 may be driven in a variety of different ways, however. For instance, it is contemplated that a rotatable head fixedly connected to the shank retracting assembly 114 may be driven by rotating the shank retracting assembly 114.

Preferably, when the rotatable head 112 stops rotating, the absence of rotational force applied to the bearings 118 enables the release of the bearings 118 from engagement with the shank 110, in preparation for the action of the shank retracting assembly 114, which compresses and spreads the hollow rivet body 104 by retracting the shank 110 rearward relative to the hollow rivet body 104. However, it is contemplated that an opposite rotational force may be required to release the bearings 118 from engagement with the shank 110. It is contemplated that the opposite rotational force may be applied to the clutch 116 in a number of different ways. For instance, the output drive shaft 122 may be driven in an opposite rotational direction to apply an opposite rotational force to the clutch 116, for releasing the bearings 118 from engagement with the shank 110. Those of ordinary skill in the art will appreciate that the opposite rotational force may be applied to the clutch 116 in many different ways without departing from the scope and intent of the present invention.

In exemplary embodiments of the present invention, the rivet setting device 100 includes a shank collection assembly 130, generally in-line with the shank retracting assembly 114, for collecting discarded shanks 110 after each shank 110 is separated from its corresponding self-tapping head 108. The shank collection assembly 130 is connected with the shank retracting assembly 114 by an ejection passage 132, permitting separated shanks 110 to be conveyed from the shank retracting assembly 114 to the shank collection assembly 130 by a spring ejection force, or the like. Those of ordinary skill in the art will appreciate that the shank collection assembly 130 may be formed or constructed in a variety of ways, including being sized appropriately for receiving a typical number of shanks which may be discarded in the course of a typical work period. Preferably, the shank collection assembly 130 is easily removed from the rivet setting device 100 for the removal of the collected shanks 110. It should be noted that it may be desirable to include a safety mechanism for preventing operation of the rivet setting device 100 while the shank collection assembly 130 is separated from the rivet setting device 100, or the like.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method for setting a self-tapping rivet of the type having a hollow rivet body and a mandrel disposed longitudinally within the hollow rivet body, the mandrel including a self-tapping head for forming a hole in a work piece and radially compressing and spreading the rivet body as the mandrel is retracted rearward relative to the rivet body and a shank having an area of reduced diameter for allowing the head to detach from the shank upon application of predetermined tensile force applied to the shank, the method comprising:

receiving the shank of the self-tapping rivet;

gripping and turning the shank for rotating self-tapping head to form a hole in a workpiece; and retracting the mandrel rearward relative to the rivet body for compressing and spreading the rivet body and thereafter separating the shank at the area of reduced diameter, wherein the self-tapping rivet is set in the work piece.

2. The method as claimed in claim 1, further comprising removing the shank after separation of the shank.

3. The method as claimed in claim 1, further comprising sensing reduction of torque in upon completion of formation of the hole in the workpiece, whereupon rotation of the clutch is stopped and the shank is retracted.

* * * * *